US012509284B2

(12) United States Patent
Chiti

(10) Patent No.: US 12,509,284 B2
(45) Date of Patent: Dec. 30, 2025

(54) LUNCH BOX

(71) Applicant: Antonio Chiti, Serravalle Pistoiese (IT)

(72) Inventor: Antonio Chiti, Serravalle Pistoiese (IT)

( * ) Notice: Subject to any disclaimer, the term of this patent is extended or adjusted under 35 U.S.C. 154(b) by 0 days.

(21) Appl. No.: 18/431,798

(22) Filed: Feb. 2, 2024

(65) Prior Publication Data

US 2024/0262586 A1 Aug. 8, 2024

(30) Foreign Application Priority Data

Feb. 2, 2023 (IT) ..... 102023000001722

(51) Int. Cl.
*B65D 53/02* (2006.01)

(52) U.S. Cl.
CPC .... *B65D 53/02* (2013.01); *B65D 2543/00277* (2013.01); *B65D 2543/00777* (2013.01); *B65D 2543/0099* (2013.01)

(58) Field of Classification Search
CPC ..... B65D 53/02; B65D 2543/002; B65D 2543/007; B65D 2543/009; A45C 11/20
USPC ..... 220/780
See application file for complete search history.

(56) References Cited

U.S. PATENT DOCUMENTS 319,932 A * 6/1885 Schneider ..... B65D 1/36 206/541
364,567 A * 6/1887 Baron ..... B65D 1/36 206/541
D744,293 S * 12/2015 Linder ..... D7/629
D744,294 S * 12/2015 Linder ..... D7/629
D744,295 S * 12/2015 Linder ..... D7/629
D1,054,797 S * 12/2024 Cai ..... D7/629
2007/0007163 A1* 1/2007 Schlattl ..... B65D 81/2038 206/544
2010/0102058 A1* 4/2010 Turvey ..... B65D 81/2038 220/361
2019/0375551 A1* 12/2019 Bell ..... B65D 25/06
2020/0189829 A1* 6/2020 Han ..... B65D 25/06
2024/0059455 A1* 2/2024 Marquit ..... B65D 81/343
2024/0150108 A1* 5/2024 Lixin ..... B65D 43/0208

* cited by examiner

*Primary Examiner* — Ernesto A Grano

(74) *Attorney, Agent, or Firm* — Patwrite Law; Mark David Torche

(57) ABSTRACT

Lunch container comprising a container body made of a metal material, provided with a bottom wall and a continuous side wall, the trailing edge of which is provided with a toroidal relief projecting radially outwardly, and a lid, comprising a flat plate, made of a metal material, along the peripheral edge of which a gasket made of an elastomeric material is overmolded, so as to encompass a portion of the peripheral edge of the plate, the gasket being formed so as to cooperate with the toroidal relief protruding from the trailing edge of the container body, and there being provided in the plate, at a given distance from the peripheral edge thereof, a recess formed from the outside to the inside of the plate, and provided with a through-hole in which is housed the valve-cap of the lid, also made of elastomeric material.

6 Claims, 2 Drawing Sheets

LUNCH BOX

The present invention relates to portable containers, and in particular relates to food containers, such as lunch boxes.

Many types of containers dedicated to the transport and consumption of prepared food are known. Among the most important features of this type of container are to be considered in particular the sealing capacity of the lid, since the container is often placed in a bag where it can disperse part of its contents, with decidedly unpleasant effects; in addition, the sturdiness of the container, its washability, and last but not least its shape, which must allow effective room management by the user, is definitely important.

While from the point of view of lid sealing effectiveness the most effective shape is undoubtedly that with a circular cross-section, this shape has the defect of reconciling poorly with the interior spaces of a backpack, rather than a travel or work bag. On the other hand, a parallelepiped container presents significant problems of effectiveness in sealing, so much so that containers of this type with rounded corners, or ellipsoidal plan are very popular. In any case, the lids of this type of container must be properly shaped to accommodate the gaskets necessary to achieve an effective seal, and often this type of manufacturing is difficult, and therefore expensive.

From the point of view of the materials used to make these containers, while plastics were widely used in the past, recently the market has definitely turned to steel, both for better characteristics from a hygienic point of view and for durability and strength, as well as for better recyclability. Of course, the problems highlighted above in terms of forming, particularly of the lid, are in this case exacerbated precisely by the inherent characteristics of the material.

It is therefore the aim of the present invention to provide a lunch box that is able to overcome the above drawbacks, which can be made of steel or similar metal material, and which can ensure an effective lid seal even by adopting an essentially parallelepiped shape of the container body, albeit with rounded corners.

It is therefore an object of the present invention to provide a lunch box comprising a container body, preferably made of a metallic material, provided with a bottom wall and a continuous side wall, the trailing edge of which is provided with a toroidal relief protruding radially outwardly, and a lid, comprising a flat plate, preferably made of a metallic material, along the peripheral edge of which is overmolded a gasket made of an elastomeric material so as to embed a portion of the peripheral edge of said plate, said gasket being formed so as to cooperate with the toroidal relief protruding from the trailing edge of the container body, and there being provided in said plate, at a given distance from the peripheral edge thereof, a cavity formed from the outside to the inside of said plate, and provided with a through-hole in which is housed the valve-cap of said lid, also made of elastomeric material.

In a preferred embodiment, the gasket is shaped with a substantially G-shaped profile, in which one side of the profile is overmolded to the plate, one side faces the outside of the container body and cooperates with said toroidal relief, and the other side is intended to cooperate with the inside of the side wall of the container body.

Advantageously, the side of the gasket profile facing outward is provided with an inner groove of a section complementary to the said toroidal relief, while the side intended to cooperate with the interior of the side wall of the container body has the free end curved toward the side of the profile overmolded on the said plate. In particular, the side of the seal profile facing outward is thicker than the side intended to cooperate with the interior of the side wall of the container body.

In a preferred embodiment, the container body and lid plate are made of steel, and preferably AISI 304 stainless steel. The thickness used is in the range of 0.5-1.0 mm, and preferably 0.7 mm. Advantageously, the container body has a basically parallelepiped shape with rounded corners, and similarly the lid plate has the same rounding. The bottom wall of the container body is slightly recessed inward.

Further advantages and features of the device according to the present invention will be apparent from the following detailed description of an embodiment of the same, rendered, for illustrative and non-limiting purposes, with reference to the attached tables of drawings, in which.

Figure 1:
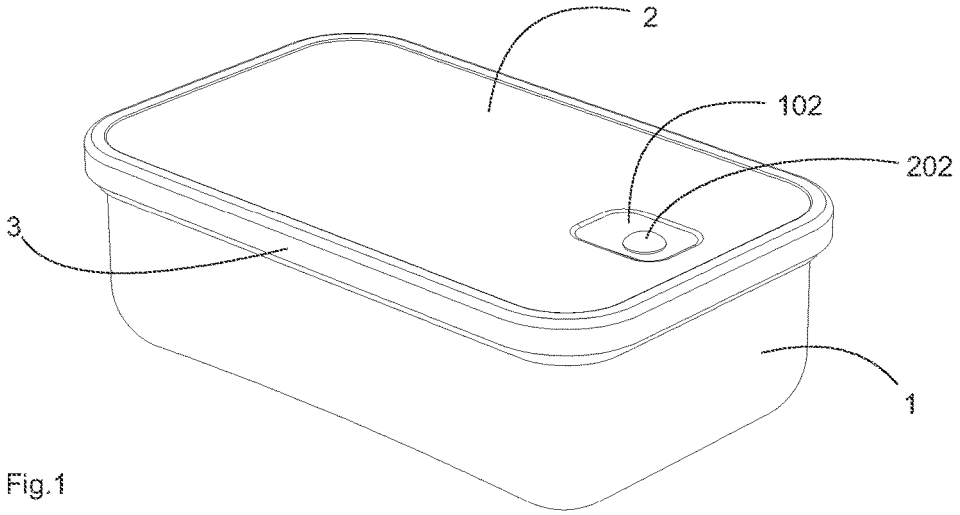
FIG. 1 is a perspective view of an embodiment of the lunchbox according to the present invention.

A perspective view of the lunch box according to the present invention is shown in FIG. 1; 1 designates the container body. A lid consisting of plate 2 and gasket 3 made of elastomeric material, overmolded on the peripheral edge of plate 2 in the manner best described and illustrated below, is placed on the container body 1, which is substantially parallelepiped in shape with beveled corners. The plate is rectangular in shape with beveled corners, consistent with the shape of the container body, and has near one of the minor sides the recess 102 in which the valve cap 202 is placed.

Figure 2:
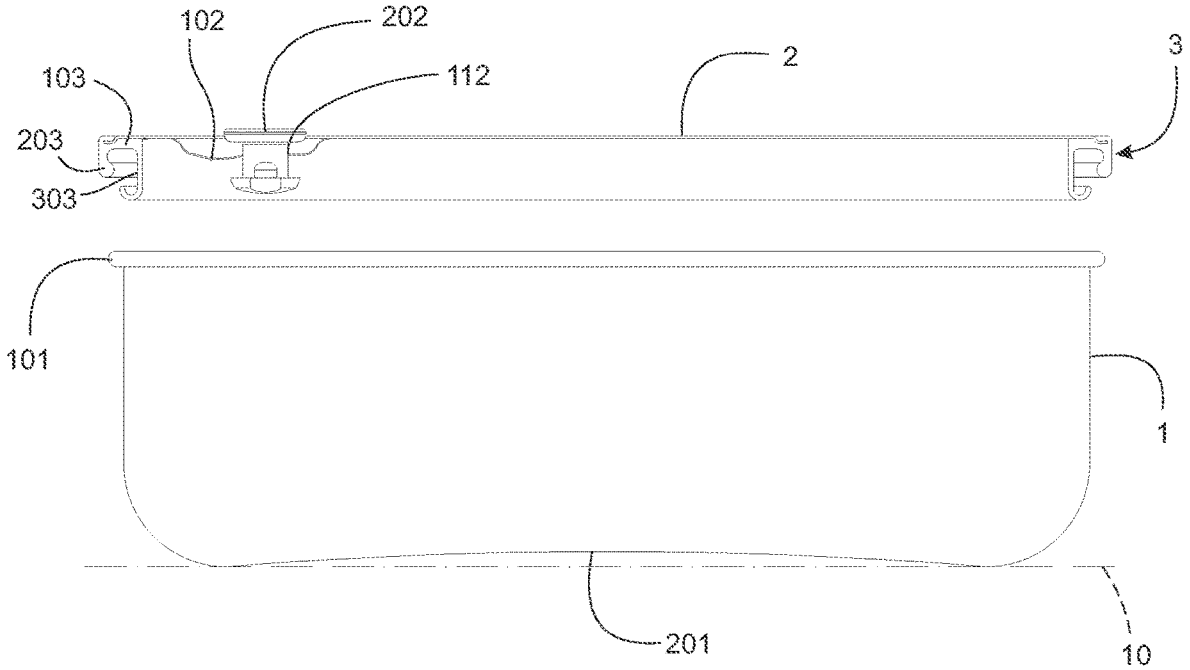
FIG. 2 is a side elevation view with cross-sectional parts of the container of FIG. 1.
Figure 3:
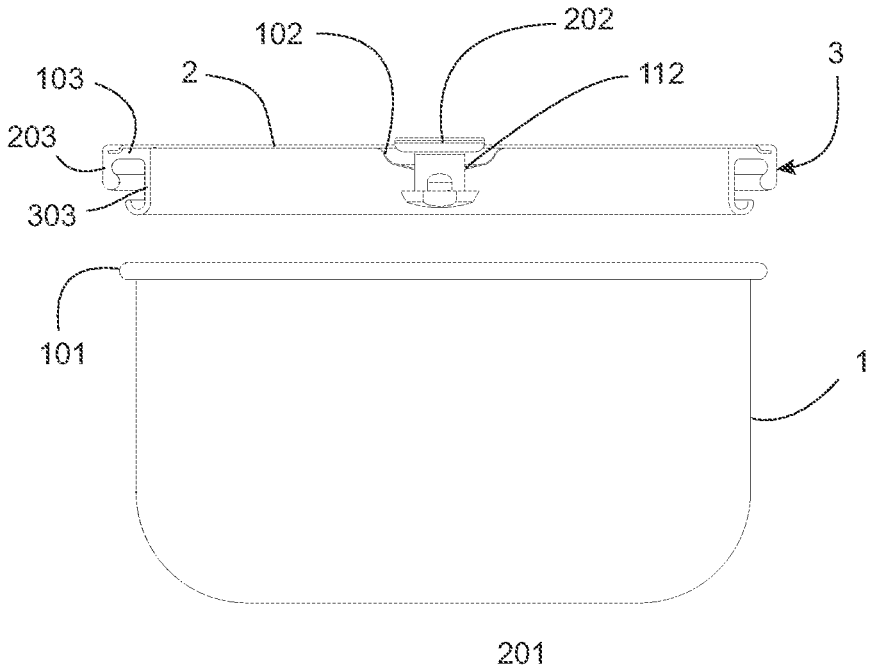
FIG. 3 is a front elevation view with sectional parts of the container of FIG. 1.

FIG. 2 shows the lunch box from FIG. 1, with the lid separated from the body 1, and longitudinally sectioned; equal parts correspond to equal numerals. Highlighted in the figure is the substantially G-shaped profile of gasket 3, in which flap 103 is the one overprinted on the peripheral edge of plate 2, flap 203 is the one facing outward, and flap 303 is the one intended to sit inside body 1. Also shown in the figure is the location of through-hole 112 in recess 102, through which hole 112 the valve cap 202 is placed. Said body 1 has on its trailing edge the toroidal relief 101 protruding outwardly and intended to cooperate with the gasket 3 in the manner better described and illustrated below. The bottom wall 201 of container body 1 is slightly recessed with respect to the lying plane 10, indicated by the dotted line in the figure. FIG. 3 shows the container body of the invention in front view with the lid sectioned in a similar manner to FIG. 2 previously described; the placement of the hole 112 in the recess 102 of the plate 2 is highlighted in the figure.

Figure 4:
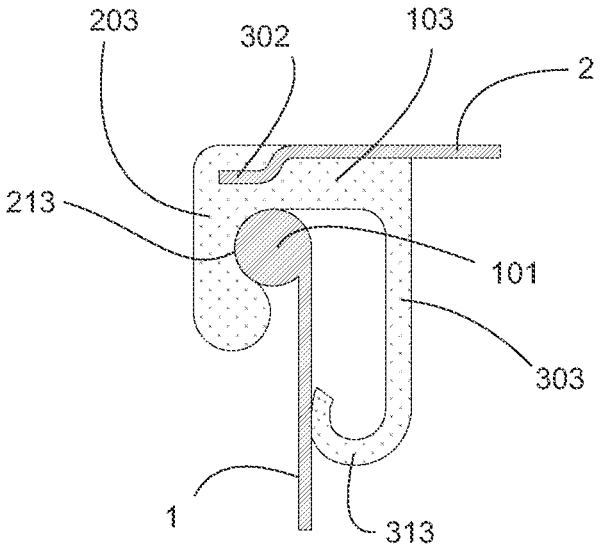
FIG. 4 is an enlarged sectional view of a detail of the container according to the present invention.

FIG. 4 shows an enlarged cross-sectional detail showing the coupling between lid gasket 3 and container body 1; equal parts correspond to equal numerals. As is evident in the figure, the toroidal relief 101 goes into the groove 213 formed on the inner face of flap 203, while the curved 313 end of flap 303 rests on the inner face of the side wall of container body 1; it should also be noted that flap 203 is of thicker section than flap 303. Plate 2 has the peripheral edge 302 slightly funneled from the plane of plate 2 itself, so as to allow for appropriate engagement between the overmolded flap 103 and plate 2.

The structure and operation of the lunch box according to the present invention will appear evident from the following. The container body is made of metal material, and preferably of AISI 304 stainless steel, i.e., the steel in usual use for steel cutlery and tableware, and the lid plate 2 is made of the same material. The thickness used, both for the container body and the lid plate, is in the range of 0.5-1.0 mm, and preferably 0.7 mm. In contrast to many lunch containers known to the state of the art, in this case it was avoided to form by complex, and therefore expensive, machining the lid so as to accommodate in it the sealing means capable of cooperating with the container body, and vice versa it was preferred to equip, by overmolding, the peripheral edge of the plate with a gasket that was capable of realizing the lid closure.

Conveniently, one portion of the gasket, i.e., the outward-facing flap 203 is thicker, so as to give solidity to the housing of the relief 101 of the trailing edge of the side wall of the container body, while the flap 303 is thinner, and thus more flexible, so as to allow its end 313 to insist on the container body wall enough to generate the seal. The gasket is made of elastomeric material, specifically food-grade silicone rubber, and the coupling between the gasket and the plate is aided by the embossing of the peripheral edge 302, which allows the same edge to be embedded in the flap 103 of the gasket profile.

The lunch box designed in this way makes it possible, on the one hand, to decisively simplify the processing of the metal parts, and on the other hand, through cooperation with the overmolded gasket, to achieve a simple and effective closing of the lid, thus realizing a sturdy, easily transportable article suitable for rational room management.

The invention claimed is:

1. A lunch container comprising a container body (1) made of a metal material, provided with a bottom wall (201) and a continuous side wall, the trailing edge of which is provided with a toroidal relief (101) projecting radially outwardly, and a lid, comprising a flat plate (2), made of a metal material, along the peripheral edge of which a gasket (3) made of an elastomeric material is overmolded, so as to encompass a portion (302) of the peripheral edge of said flat plate (2), said gasket (3) being formed so as to cooperate with the toroidal relief protruding from the trailing edge of the container body (1), and there being provided in said plate (2), at a given distance from the peripheral edge thereof, a recess (102) formed from the outside to the inside of said flat plate (2), and provided with a through-hole (112) in which is housed the valve-cap (202) of said lid, also made of elastomeric material, wherein the gasket (3) is shaped with a substantially G-shaped profile, in which one flap (103) of the profile is overprinted on the flat plate (2), one flap (203) faces the outside of the container body and cooperates with said toroidal relief (101), and the other flap (303) is intended to cooperate with the inner face of the side wall of the container body (1).

2. The lunch container according to claim 1, in which the flap (203) of the seal profile facing outward is provided with an inner groove (213) of complementary cross-section to said toroidal relief (101), while the flap (313) intended to cooperate with the inner face of the side wall of the container body (1) has the free end curved toward the flap (103) of the profile overmolded on said flat plate (2).

3. The lunch container according to claim 1, in which the flap (203) of the seal profile facing outward is thicker than the flap (303) intended to cooperate with the inner face of the side wall of the container body (1).

4. The lunch container according to claim 1, in which the container body (1) and flat plate (2) are made of steel.

5. The lunch container according to claim 4, in which the thickness of the steel plate used to make the container body and flat plate is in the range of 0.5-1.0 mm.

6. The lunch container according to claim 1, in which the container body has a substantially parallelepiped shape with rounded corners, and similarly the lid plate shows the same rounding.

* * * * *